US006329328B1

(12) United States Patent
Koganei et al.

(10) Patent No.: US 6,329,328 B1
(45) Date of Patent: Dec. 11, 2001

(54) LUBRICANT OIL COMPOSITION FOR INTERNAL COMBUSTION ENGINES

(75) Inventors: Katsuya Koganei, Ohi-machi; Satoshi Ogano, Fujimi; Toshiaki Kuribayashi, Tsurugashima, all of (JP)

(73) Assignee: Tonen General Sekiyu K. K., Saitama (JP)

( * ) Notice: Subject to any disclaimer, the term of this patent is extended or adjusted under 35 U.S.C. 154(b) by 0 days.

(21) Appl. No.: 09/580,687

(22) Filed: May 30, 2000

(51) Int. Cl.[7] ..... C10M 141/06; C10M 141/12

(52) U.S. Cl. ..... 508/365; 508/376; 508/378; 508/518

(58) Field of Search ..... 508/365, 376, 508/378, 518

(56) References Cited

U.S. PATENT DOCUMENTS

| | | | | |
|---|---|---|---|---|
| 4,812,246 | | 3/1989 | Yabe | 252/32.7 |
| 5,569,405 | | 10/1996 | Nakazato et al. | 508/192 |
| 5,665,684 | * | 9/1997 | Arai et al. | 508/364 |
| 5,672,572 | * | 9/1997 | Arai et al. | 508/364 |
| 5,744,430 | * | 4/1998 | Inoue et al. | 508/376 |
| 5,906,969 | * | 5/1999 | Fyfe | 508/364 |
| 5,916,851 | * | 6/1999 | Hosonuma et al. | 508/363 |
| 6,074,993 | * | 6/2000 | Waddoups et al. | 508/364 |
| 6,114,288 | * | 9/2000 | Fujitsu et al. | 508/376 |

OTHER PUBLICATIONS

Japanese Patent Publication No. 3–329839 equivalent.

Japanese Patent Publication No. 6–60317, Derwent 88–060458/09.

Japanese Patent Publication No. 2,564,556B2, Derwent 89–050214/07.

Japanese Patent Publication No. 07126681–A, Derwent 95–213285/28.

Japanese Patent Publication No. 07207292–A, Derwent 95–309401/40.

* cited by examiner

*Primary Examiner*—Jacqueline V. Howard
(74) *Attorney, Agent, or Firm*—Linda M. Scuorzo

(57) ABSTRACT

The present invention provides for a lubricant oil composition for internal combustion engines for automobiles with enhanced friction loss reduction and is especially suitable for a pressure-accumulating (common rail) type diesel engine equipped with an EGR system. The lubricant oil composition contains a base oil composed of a mineral and/or synthetic oil incorporated with at least four additives of (A) at least one type of organomolybdenum compound selected from the group consisting of sulfurized oxymolybdenum dithiocarbamate, sulfurized oxymolybdenum dithiophosphate, molybdenum phosphate and molybdenum-amine complex at 0.01 to 0.20 wt. % as Mo, (B) zinc dialkyl dithiophosphate at 0.01 to 0.50 wt. % as P, (C) one of Ca and Mg salts of alkyl salicylate at 0.05 to 1.0 wt. % as Ca or Mg and (D) Zn salt of alkyl salicylate at 0.005 to 0.2 wt. % as Zn, all percentages being based on the whole composition, especially suitable for a pressure-accumulating (common rail) type diesel engine equipped with an exhaust gas recirculation (EGR) system.

2 Claims, No Drawings

LUBRICANT OIL COMPOSITION FOR INTERNAL COMBUSTION ENGINES

FIELD OF THE INVENTION

This invention relates to a lubricant oil composition for internal combustion engines, more particularly the composition with enhanced in friction loss reducing properties for internal combustion engines for automobiles and sustaining its effect for extended periods, especially suitable for a pressure-accumulating type (common rail type) diesel engine equipped with an exhaust gas recirculation (which may be referred to as EGR) system.

BACKGROUND OF THE INVENTION

Lubricant oils have been used to lubricate internal combustion engines, devices in driving systems (e.g., automatic transmissions, shock absorbers and power steerings) and gears having sliding mechanical parts for their smooth operation. In particular, lubricant oil for internal combustion engines are used mainly for piston rings, cylinder liners, bearings for crank shafts and connecting rods, valve trains including cams and valve lifters, and other sliding mechanical parts. They are also used for cooling the engines, cleaning and dispersing combustion products, and preventing rust and corrosion, in addition to the lubricating purposes. As described above, lubricant oils for internal combustion engines are required to exhibit a variety of functions. These requirements are becoming even severer, as the engines become more functional, produce higher power and are operated under severer conditions.

In order to satisfy these requirements, lubricant oils for internal combustion engines are incorporated with a variety of additives, such as antiwear agent, metallic detergent, ashless dispersant and antioxidant. The essential functions of a lubricant oil for internal combustion engines are to prevent wear and seizure by helping the engine operate smoothly under all conditions. Hydrodynamic lubrication prevails in lubricated engine mechanical parts, but boundary lubrication tends to occur in some sections, e.g., valve trains and dead centers in the cylinders. In general, zinc dithiophosphate or the like is added to prevent wear in the boundary lubrication areas.

More recently, abatement of $CO_2$ emissions has been actively pursued, in order to prevent global warming. It is necessary in Japan to improve fuel economy of diesel engines by 14.9% on the average over the 1995 level from 2005 on, which also urges to develop fuel-saving characteristics of diesel engine oils.

An internal combustion engine loses energy greatly in the frictional sections for which a lubricant oil is used. Therefore, a lubricant oil for internal combustion engines is incorporated with a combination of various additives, e.g., friction modifier, in order to reduce friction losses and fuel consumption (as disclosed by, e.g., Japanese Patent Publication No. 3-23595). Internal combustion engines are operated under widely varying conditions with respect to oil temperature, rotational speed and load, and a lubricant oil for internal combustion engines is required to exhibit low friction coefficient under widely varying service conditions, in order to further improve fuel efficiency.

A variety of techniques have been proposed to reduce friction coefficient of lubricating oil, e.g., incorporation of various additives, such as an organomolybdenum compound, and combination of organomolybdenum compound and metallic detergent (e.g., Japanese Patent Publication No. 6-62983, abstract); and combination of organomolybdenum compound and sulfur-based compound (e.g., Japanese Patent Publication No. 5-83599, abstract), and combination of organomolybdenum compound, zinc dithiophosphate and sulfur-based compound (e.g., Japanese Laid-open Patent Application No. 8-73878 EP699-739). The examples of friction reducing agents other than an organomolybdenum compound include a combination of a partial ester of fatty acid with glycerol and organocopper compound (e.g., Japanese Patent Publication No. 3-77837, abstract), and a combination of a pentaerythiritol ester and succinimide or zinc dithiophosphate (e.g., Japanese Laid-open Patent Application No. 55-80494 CA1136606 and 55-82195 U.S. Pat. No. 4,584,112).

However, in case of a diesel engine, unlike gasoline engine, the engine oil tends to be contaminated with large quantities of soot generated as a result of incomplete combustion of diesel fuel oil. It is reported that the soot, having surface activity, may adsorb a polar additive in the engine oil and scrape off a film layer formed on the rubbing surface. The required functions of a friction-reducing agent for diesel engines, therefore, should be much different from those of the agent for gasoline engines under the severe friction conditions with the engine oil contaminated with soot. Therefore, the conventional friction- reducing agents, e.g., organomolybdenum compound, amine, amide and phosphate ester, may not sufficiently improve fuel economy. Only a limited number of proposals have been made to improve fuel economy of diesel engines, including incorporation in the base oil of hydrated borate of an alkali metal (e.g., Japanese Patent Publication No. 1-48319, abstract).

Air pollution by exhaust gases (in particular, NOx) from diesel engines is becoming more severe worldwide, and there are movements to introduce more stringent regulations on NOx and particulate matter emissions from diesel engines. Engine makers are responding to these regulations by an EGR system, which is already adopted for gasoline engines, to clear the NOx regulations. Some of the problems involved in use of an EGR system are still more increased quantities of soot in the lubricant oil to aggravate wear of valve trains and piston-cylinder interfaces, and to prevent the friction-reducing agent from fully exhibiting its inherent characteristics of improving fuel economy. Moreover, it should be noted that abatement of NOx and particulate matter run counter to each other, when an EGR system is adopted for NOx abatement. One of the methods trying to solve problems of increased particulate matter in an EGR-equipped engine is use of high-pressure fuel injection, where high-pressure fuel is stored in a pressure-accumulating piping system (referred to as common rail) by means of a fuel supply pump and then injected into each engine cylinder under pressure from the common rail via a valve, to improve combustion conditions. It is considered to be important that the future diesel engine must be equipped with an EGR system and pressure-accumulating type fuel injector simultaneously to clear the more stringent exhaust gas regulations. This pressure-accumulating type injector will greatly improve combustion conditions, thereby reducing contamination of the oil with soot.

In spite of these improvements of the engine side, the conventional friction-reducing agent compounding techniques have failed to give the agent which allows the lubricating oil composition to improve fuel economy of diesel engines for extended periods.

It is also known that reducing viscosity of engine oil is one of the effective means to improve fuel economy, and multi-grade diesel engine oils with low-viscosity base oils incorporated with a viscosity index improver, e.g., polymethacrylate and ethylene-propylene copolymer, have been generally used.

However, the effect of improving fuel economy by a multi-grade diesel engine oil incorporated only with a viscosity index improver is far from sufficient. Therefore, there are strong demands for more advanced lubricant oil compositions which exhibit satisfactory effects of improving fuel economy for diesel and gasoline engines stably for extended periods.

SUMMARY OF THE INVENTION

The present invention relates to a lubricant oil composition for internal combustion engines, comprising a base oil composed of a mineral and/or synthetic oil incorporated with at least four additives of (A) at least one type of organomolybdenum compound selected from the group consisting of sulfurized oxymolybdenum dithiocarbamate, sulfurized oxymolybdenum dithiophosphate, molybdenum phosphate and molybdenum-amine complex at 0.01 to 0.20 wt. % as Mo, (B) zinc dialkyl dithiophosphate at 0.01 to 0.50 wt. % as P, (C) one of Ca and Mg salts of alkyl salicylate at 0.05 to 1.0 wt. % as Ca or Mg, and (D) Zn salt of alkyl salicylate at 0.005 to 0.2 wt. % as Zn, all percentages being based on the whole composition. The present invention also provides for a method for lubricating an internal combustion engine and for enhancing the friction loss reduction properties of a lubricating oil composition by adding the above compounds thereto. The present invention may comprise, consist or consist essentially of the elements or steps recited herein.

DETAILED DESCRIPTION OF THE PREFERRED EMBODIMENTS

The present invention provides for a lubricant oil composition for internal combustion engines for automobiles, having enhanced friction loss reduction properties which compositions are especially suitable for a pressure-accumulating (common rail) type diesel engine equipped with an EGR system.

The inventors have found that a lubricant oil composition incorporated with specific organomolybdenum compound, zinc dithiophosphate and two types of metallic salts of alkyl salicylate (which may be referred to as mere salicylate) at a specific content shows a surprisingly low coefficient of friction, even under the lubricating conditions with soot in the oil.

One embodiment of this invention provides a lubricant oil composition for internal combustion engines, comprising a base oil composed of a mineral and/or synthetic oil incorporated with at least four additives of (A) at least one type of organomolybdenum compound selected from the group consisting of sulfurized oxymolybdenum dithiocarbamate, sulfurized oxymolybdenum dithiophosphate, molybdenum phosphate and molybdenum-amine complex at 0.01 to 0.20 wt. % as Mo, (B) zinc dialkyl dithiophosphate at 0.01 to 0.50 wt. % as P, (C) one of Ca and Mg salts of alkyl salicylate at 0.05 to 1.0 wt. % as Ca or Mg, and (D) Zn salt of alkyl salicylate at 0.005 to 0.2 wt. % as Zn, all percentages being based on the whole composition. The present invention also provides the above lubricant oil composition, which is used for a pressure-accumulating (common rail) type diesel engine equipped with an exhaust gas recirculation (EGR) system.

This invention relates, as described above, to the lubricant oil composition comprising a base oil incorporated with an organomolybdenum compound, zinc dialkyl dithiophosphate, Ca or Mg salt of alkyl salicylate, and Zn salt of alkyl salicylate at a specific content, for internal combustion engines, especially a pressure-accumulating (common rail) type diesel engine equipped with an EGR system.

Preferred embodiments of the present invention include:

A lubricant oil composition of one of the above, wherein the base oil is incorporated with a sulfurized oxymolybdenum dithiocarbamate as the organomolybdenum compound at 0.05 to 0.20 wt. % (500 to 2000 ppm) as Mo.

A lubricant oil composition of one of the above, wherein the base oil is incorporated with a zinc dialkyl dithiophosphate at 0.06 to 0.20 wt. % (600 to 2000 ppm) as P.

A lubricant oil composition of one of the above, wherein the base oil is further incorporated with at least one sulfur-based compound selected from the group consisting of a sulfurized ester and polysulfide at 0.02 to 0.30 wt. % as S.

A lubricant oil composition of one of the above, which is used under the lubricating condition with 0.2 to 5.0 wt. % of soot in the oil.

A lubricant oil composition of one of the above, wherein the zinc dialkyl dithiophosphate is a mixed alkyl group with a primary and secondary alkyl group.

A lubricant oil composition of one of the above, wherein the Ca or Mg salt of alkyl salicylate has a total base number of 50 to 400 mg KOH/g.

A lubricant oil composition of one of the above, wherein the Zn salt of alkyl salicylate has a total base number of 50 to 300 mg KOH/g.

A method for enhancing the friction loss reduction properties of a lubricating oil for an internal combustion engine by adding to the engine a lubricating oil composition described above.

A method for lubricating an internal combustion engine by adding to engine a lubricating oil composition described above.

The present invention is further described, below.

Lubricant Base Oil

The base oil for the lubricant oil composition of the present invention is not limited, and any one which is normally used as a lubricant base oil can be used. In other words, it may be a mineral oil, synthetic oil or a mixture thereof.

The mineral oils useful for the present invention include lubricant stocks, obtained by atmospheric or vacuum distillation of crude, which are treated by various processes, e.g., raffinate from solvent extraction with an aromatic extractant such as phenol, furfural and N-methyl pyrrolidone; hydroreated oil obtained by treating lubricant stocks with hydrogen under hydrotreatment conditions in the presence of a hydrotreatment catalyst; isomerate obtained by isomerizing wax with hydrogen under isomerization conditions in the presence of an isomerization catalyst; and those lubricant fractions obtained by a combination of solvent refining, hydrotreatment or isomerizatrion. Any process described above can be optionally combined with dewaxing, hydrofmishing, clay treatment or the like operated in a normal manner. More specifically, the mineral oils for the present invention include light, medium and heavy neutral oils, and bright stocks. These base oils can be mixed with one another, to satisfy the requirements of the present invention.

The examples of synthetic base oils useful for the present invention include poly-α-olefin, α-olefin oligomer, polybutene, alkylbenzene, polyol ester, dibasic acid ester, polyoxyalkylene glycol, polyoxyalkylene glycol ether, and silicone oil.

These base oils may be used individually or in combination. A mineral oil may be combined with a synthetic oil. The base oil for the present invention generally has a kinematic viscosity of 2 to 20 $mm^2/s$ at 100° C., preferably 3 to 15 $mm^2/s$. Viscosity beyond the above range causes problems, e.g., excessively increased agitation resistance and coefficient of friction in the hydrodynamic lubrication region to deteriorate fuel-saving characteristics when it exceeds the above range, and increased wear at sliding mechanical parts (e.g., valve trains, pistons, rings and bearings of diesel engines) when it is below the above range.

Organomolybdenum Compound

The organomolybdenum compound as the essential component (A) for the lubricant oil composition of the present invention is at least one type selected from the group consisting of sulfurized oxymolybdenum dithioarbamate (MoDTC), sulfurized oxymolybdenum dithiophosphate (MoDTP), molybdenum phosphate and molybdenum-amine complex.

The sulfurized oxymolybdenum dithiocarbamate (MoDTC) as the organomolybdenum compound for the lubricant oil composition of the present invention is shown by the general formula [1]:

[1]

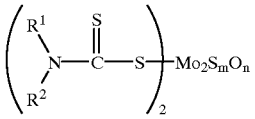

wherein, $R^1$ and $R^2$ are each a hydrocarbon group having a carbon number of 4 to 18, and may be the same or different; and (m) and (n) are each an integer making 4. The hydrocarbon groups of $R^1$ and $R^2$ in the general formula [1] having a carbon number of 4 to 18 include an alkyl group having a carbon number of 4 to 18, alkenyl group having a carbon number of 4 to 18, cycloalkyl group having a carbon number of 4 to 18, and aryl, alkyl aryl and aryl alkyl group having a carbon number of 6 to 18. These alkyl and alkenyl groups may be of straight-chain or branched. The hydrocarbon group shown by $R^1$ or $R^2$ for the present invention particularly preferably has a carbon number of 4 to 13. The concrete examples of the hydrocarbon groups shown by $R^1$ and $R^2$ include butyl, pentyl, hexyl, heptyl, 2-ethyl hexyl, octyl, nonyl, decyl, undecyl, dodecyl, tridecyl, octenyl, nonenyl, decenyl, undecenyl, dodecenyl, tridecenyl, tetradecenyl, hexadecenyl, octadecenyl, dimethyl cyclohexyl, ethyl cyclohexyl, methyl cyclohexylmethyl, cyclohexylethyl, propyl cyclohexyl, butyl cyclohexyl, heptyl cyclohexyl, dimethyl phenyl, methyl benzyl, phenetyl, naphthyl, and dimethyl naphthyl.

The sulfurized oxymolybdenum dithiophosphate (MoDTP) as the organomolybdenum compound for the lubricant oil composition of the present invention is shown by the general formula [2]:

[2]

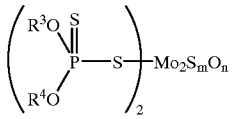

wherein, $R^3$ and $R^4$ are each a hydrocarbon group having a carbon number of 4 to 18, and may be the same or different; and (m) and (n) are each an integer making 4. The hydrocarbon groups of $R^3$ and $R^4$ in the general formula [2] having a carbon number of 4 to 18 include an alkyl group having a carbon number of 4 to 18, alkenyl group having a carbon number of 4 to 18, cycloalkyl group having a carbon number of 4 to 18, and aryl, alkyl aryl and aryl alkyl group having a carbon number of 6 to 18. These alkyl and alkenyl groups may be of straight-chain or branched. The hydrocarbon group shown by $R^3$ or $R^4$ for the present invention particularly preferably has a carbon number of 4 to 13. The concrete examples of the hydrocarbon groups shown by $R^3$ and $R^4$ include butyl, pentyl, hexyl, heptyl, 2-ethyl hexyl, octyl, nonyl, decyl, undecyl, dodecyl, tridecyl, octenyl, nonenyl, decenyl, undecenyl, dodecenyl, tridecenyl, tetradecenyl, hexadecenyl, octadecenyl, dimethyl cyclohexyl, ethyl cyclohexyl, methyl cyclohexylmethyl, cyclohexylethyl, propyl cyclohexyl, butyl cyclohexyl, heptyl cyclohexyl, dimethyl phenyl, methyl benzyl, phenetyl, naphthyl, and dimethyl naphthyl.

The molybdenum phosphate as the organomolybdenum compound for the lubricant oil composition of the present invention is shown by the general formula [3]:

[3]

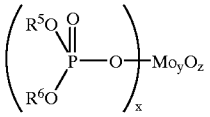

wherein, $R^5$ and $R^6$ are each a hydrocarbon group having a carbon number of 4 to 18, and may be the same or different; and (x), (y) and (z) is 3 or less. The hydrocarbon groups of $R^5$ and $R^6$ in the general formula [3] having a carbon number of 4 to 18 include an alkyl group having a carbon number of 4 to 18, alkenyl group having a carbon number of 4 to 18, cycloalkyl group having a carbon number of 4 to 18, and aryl, alkyl aryl and aryl alkyl group having a carbon number of 6 to 18. These alkyl and alkenyl groups may be of straight-chain or branched. The hydrocarbon group shown by $R^5$ or $R^6$ for the present invention particularly preferably has a carbon number of 4 to 13. The concrete examples of the hydrocarbon groups shown by $R^5$ and $R^6$ include butyl, pentyl, hexyl, heptyl, 2-ethyl hexyl, octyl, nonyl, decyl, undecyl, dodecyl, tridecyl, octenyl, nonenyl, decenyl, undecenyl, dodecenyl, tridecenyl, tetradecenyl, hexadecenyl, octadecenyl, dimethyl cyclohexyl, ethyl cyclohexyl, methyl cyclohexylmethyl, cyclohexylethyl, propyl cyclohexyl, butyl cyclohexyl, heptyl cyclohexyl, dimethyl phenyl, methyl benzyl, phenetyl, naphthyl, and dimethyl naphthyl.

The molybdenum-amine complex as the organomolybdenum compound for the lubricant oil composition of the present invention is shown by the general formula [4]:

[4]

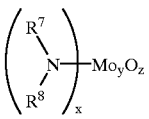

wherein, $R^7$ and $R^8$ are each a hydrocarbon group having a carbon number of 4 to 18, and may be the same or different; and (x), (y) and (z) is 3 or less. The hydrocarbon groups of $R^7$ and $R_8$ in the general formula [4] having a carbon number of 4 to 18 include an alkyl group having a carbon number of 4 to 18, alkenyl group having a carbon number of 4 to 18, cycloalkyl group having a carbon number of 4 to 18, and aryl, alkyl aryl and aryl alkyl group having a carbon number of 6 to 18. These alkyl and alkenyl groups may be of straight-chain or branched. The hydrocarbon group shown by $R^7$ or $R^8$ for the present invention particularly preferably has a carbon number of 4 to 13. The concrete examples of the hydrocarbon groups shown by $R^7$ and $R^8$ include butyl, pentyl, hexyl, heptyl, 2-ethyl hexyl, octyl, nonyl, decyl, undecyl, dodecyl, tridecyl, octenyl, nonenyl, decenyl, undecenyl, dodecenyl, tridecenyl, tetradecenyl, hexadecenyl, octadecenyl, dimethyl cyclohexyl, ethyl cyclohexyl, methyl cyclohexylmethyl, cyclohexylethyl, propyl cyclohexyl, butyl cyclohexyl, heptyl cyclohexyl, dimethyl phenyl, methyl benzyl, phenetyl, naphthyl, and dimethyl naphthyl.

These organomolybdenum compounds may be used either individually or in combination for the present invention. The organo-molybdenum compound is incorporated at 0.01 to 0.20 wt. % (100 to 2000 ppm) as molybdenum (Mo) derived therefrom, based on the whole composition, preferably 0.04 to 0.20 (400 to 2000 ppm), more preferably 0.05 to 0.2 (500 to 2000 ppm). At below 0.01 wt. %, the lubricant oil may not sufficiently exhibit its friction-reducing effect. At above 0.20 wt. %, on the other hand, the effect is not increased for the quantity of the organomolybdenum compound used, and sludge may be formed more easily.

Zinc Dialkyl Dithiophosphate

The zinc dialkyl dithiophosphate (ZnDTP) as one of the essential component (B) for the lubricant oil composition of the present invention is shown by the general formula [5]:

[5]

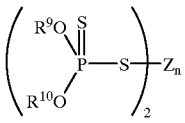

wherein, $R^9$ and $R^{10}$ are each a primary or secondary alkyl group having a carbon number of 1 to 18, and may be the same or different. The primary or secondary alkyl groups of $R^9$ and $R_{10}$ having a carbon number of 1 to 18, shown by the general formula [5], include methyl, ethyl, propyl, butyl, pentyl, hexyl, heptyl, 2-ethyl hexyl, octyl, nonyl, decyl, undecyl, dodecyl, tridecyl, tetradecyl, pentadecyl, hexadecyl, heptadecyl, and octadecyl. However, the preferable zinc dialkyl dithiophosphate for the lubricant oil composition of the present invention has a mixed alkyl group of primary and secondary alkyl groups having a carbon number of 3 to 12. The primary alkyl group would be mainly used when resistance of the lubricant oil composition to heat and oxidation are of critical importance. However, it may cause increased wear at valve trains and other mechanical parts as content of soot in the oil increases as a result of exhaust gas recirculation used for cleaning the exhaust gases, and hence normally used in combination with the secondary alkyl to control the wear. The zinc dialkyl dithiophosphates having a mixed alkyl group of primary and secondary alkyl groups may be used either individually or in combination for the lubricant oil composition of the present invention. The zinc dialkyl dithiophosphate is incorporated at 0.01 to 0.50 wt. % as phosphorus (P) derived therefrom, based on the whole composition, preferably 0.06 to 0.20 wt. %. At below 0.01 wt. %, the lubricant oil may not sufficiently exhibit its friction-reducing effect under the lubricating conditions with soot in the oil, because of increased wear. At above 0.50 wt. %, on the other hand, the friction-reducing and wear-preventive effects are not increased for the quantity of the dithiophosphate used.

Metallic Salt of Alkyl Salicylate

The metallic (Ca, Mg or Zn) salt of alkyl salicylate as the essential component (C) or (D) for the lubricant oil composition of the present invention is shown by the general formula [6] or [7]:

[6]

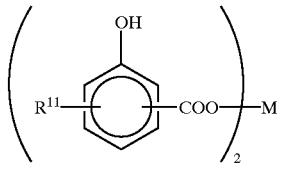

[7]

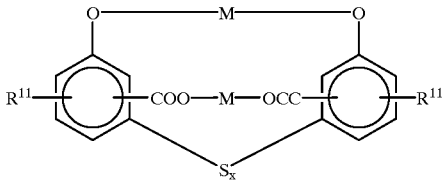

The compound shown by the general formula [7] is a sulfide of the metallic salt shown by the general formula [6]: wherein, $R^{11}$ in the general formula [6] or [7] is an alkyl group having a carbon number of 1 to 18; M is calcium or magnesium as an alkaline-earth metal, or zinc as a Group 2B metal; and (x) is an integer of 1 to 4. The alkyl groups of $R^{11}$ in the general formula [6] or [7] include methyl, ethyl, propyl, butyl, pentyl, hexyl, heptyl, 2-ethyl hexyl, octyl, nonyl decyl, undecyl, dodecyl, tridecyl, tetradecyl, pentadecyl, hexadecyl, heptadecyl, and octadecyl. However, the preferable alkyl group for the lubricant oil composition of the present invention is of straight chain or branched, having a carbon number of 4 to 20. A boron derivative of the above metallic salt of alkyl salicylate may be also used.

The Ca or Mg salt of alkyl salicylate as the component (C) for the present invention preferably has a total base number of 50 to 400 mg KOH/g, more preferably 100 to 200 mg KOHI/g, for its acid-neutralizing effect and availability, although its total base number is not limited. Total base number is determined by the perchloric acid method, in accordance with JIS K2501.

The Ca or Mg salt of alkyl salicylate is incorporated at 0.05 to 1.0 wt. % as Ca or Mg, based on the whole composition, preferably 0.1 to 0.7 wt. %. At below 0.05 wt. %, the lubricant oil may not sufficiently exhibit its friction-reducing effect under the lubricating conditions with soot in the oil. On the other hand, at above 1.0 wt. %, the effect is not increased for the quantity of the metallic salt used.

The Zn salt of alkyl salicylate as the component (D) for the present invention preferably has a total base number of 50 to 300 mg KOH/g, more preferably 100 to 200 mg KOH/g, for its acid-neutralizing effect and availability, although its total base number is also not limited.

The Zn salt of alkyl salicylate is incorporated at 0.005 to 0.2 wt. % as Zn, based on the whole composition, preferably 0.01 to 0.1 wt. %. At below 0.005 wt. %, the lubricant oil may not sufficiently exhibit its friction-reducing effect and the effect may not be sustainable under the lubricating conditions with soot in the oil. At above 0.2 wt. %, on the other hand, the effect is not increased for the quantity of the metallic salt used.

Sulfur-based Compound

The lubricant oil composition of the present invention comprises a base oil incorporated with the above-described essential components of organomolybdenum compound, zinc dialkyl dithiophosphate and two types of metallic salts of alkyl salicylate at a specific content, and preferably further with a sulfur compound as the sulfur-supplying component for fuel-saving effect. The sulfur compound is to maximize the effects of the organomolybdenum compound as the essential component (A). The sulfur useful for the present invention may be present in the base oil, organomolybdenum compound molecule or a sulfur-based compound added as an additive, preferably in the organomolybdenum compound molecule or a sulfur-based compound added as an additive.

The compounds useful as the effective sulfur-supplying component include, in addition to the zinc dithiophosphate as the essential component (B), an ashless sulfide compound (e.g., dibutyl disulfide, dibenzyl disulfide, and polysulfide), sulfurized olefin, sulfurized oil and fat, sulfurized ester, tetraalkyl thioperoxyphosphate, and metallic salt of dithiocarbamate (e.g., zinc and bismuth salts). Of these, sulfurized olefin, sulfurized ester and polysulfide are especially preferable. The lubricant oil composition of the present invention will have still improved friction-reducing effect, when the sulfur-supplying component is used in combination with the organomolybdenum compound.

The lubricant oil composition of the present invention may be incorporated with one or more types of the above sulfur-based compounds, in addition to the essential components. The sulfur-based compound is incorporated at 0.02 to 0.3 wt. % as sulfur derived therefrom, based on the whole composition, preferably 0.1 to 0.3 wt. %. At below 0.02 wt. %, the target effect may not be realized. At above 0.3 wt. %, on the other hand, corrosion wear may be aggravated.

The lubricant oil composition of the present invention exhibits notable friction-reducing effect, when used as the lubricant oil for internal combustion engines such as those for automobiles, by incorporating its base oil with the essential components of organomolybdenum compound, zinc dialkyl dithiophosphate and two types of metallic salts of alkyl salicylate, and further with a sulfur compound as the optional sulfur-supplying component. In particular, it exhibits friction-reducing effect stably for extended periods under the lubricating conditions with soot in the oil.

The lubricant oil composition of the present invention is used for a diesel engine which operates under the lubricating conditions with relatively large quantities of soot in the oil. Content of soot in the lubricating oil is in a range from 0.2 to 5.0 wt. %, preferably 0.2 to 3.0 wt. %. Soot content (wt. %) in the oil, described in this specification, means content of n-hexane-insolubles, determined by the ultracentrifugation method (centrifugal force: 36,790 G, speed of rotation: 17,500 rpm, time: 30 min, number of runs: 3, temperature: 0C).

Other Additive Components

The lubricant oil composition of the present invention comprises a base oil incorporated with the essential components of organomolybdenum compound, zinc dialkyl dithiophosphate and two types of metallic salts of alkyl salicylate at a specific content. The base oil may be optionally incorporated further with one or more types of additives, in order to meet various functions the lubricant oil for diesel engines is required to exhibit, so long as the object of the present invention is not damaged. These additives include viscosity index improver, pour point depressant, ashless dispersant, metallic detergent, anti-oxidant, friction-reducing agent, antiwear agent, extreme pressure agent, metal deactivator, rust inhibitor, antifoamant, corrosion inhibitor and coloring agent.

The viscosity index improvers useful for the present invention generally include a polymethacrylate-based one, olefin copolymer-based one (e.g., polyisobutylene-based and ethylene-propylene copolymer-based one), polyalkyl styrene-based one, hydrogenated styrene-butadiene copolymer-based one, and styrene-maleic anhydride ester copolymer-based one. It is incorporated normally at 1 to 30 wt. %.

The pour point depressants useful for the present invention generally include an ethylene-vinyl acetate copolymer, condensate of chlorinated paraffin and naphthalene, condensate of chlorinated paraffin and phenol, poly-methacrylate, and polyalkyl styrene. Of these, a polymethacrylate is preferably used. It is incorporated normally at 0.01 to 5 wt. %.

The ashless dispersants useful for the present invention include those based on a polyalkenyl succinimide, polyalkenyl succinamide, benzyl amine, succinic acid ester, and succinic acid-amide, and those containing boron. Of these, a polyalkenyl succinimide (polybutenyl succinimide)-based one is preferably used. It is incorporated normally at 0.1 to 15 wt. %.

The metallic detergents useful for the present invention include those based on sulfonate, phenate, salicylate and phosphonate of Ca, Mg, Ba, Na or the like, in addition to the salicylate of Ca, Mg or Zn as the essential component for the lubricant oil composition of the present invention. It is incorporated normally at 0.05 to 5 wt. %.

The antioxidants useful for the present invention generally include an amine-based one, e.g., alkylated diphenyl amine, phenyl-α-naphthyl amine and alkylated phenyl-α-naphthyl amine; phenol-based one, e.g., 2,6-ditertiary butyl phenol and 4,4'-methylene bis-(2,6-ditertiary butyl phenol); sulfur-based one, e.g., dilauryl-3,3'-thiodipropiomate; phosphorus-based one, e.g., phosphite; and zinc dithiophosphate. Of these, an amine-based and phenol-based one are preferably used. It is incorporated normally at 0.05 to 5 wt. %.

The friction-reducing agents useful for the present invention include a fatty acid, higher alcohol, fatty acid ester, partial ester of polyhydric alcohol, fatty acid ester, oil and fat, amine, amide, sulfurized ester, phosphate ester, phosphite ester and phosphate ester amine, in addition to the organo-molybdenum compound as the essential component for the present invention. It is incorporated normally at 0.05 to 3 wt. %.

The antiwear agents useful for the present invention include a metallic (e.g., Pb, Sb or Mo) salt of dithiophosphate, metallic (e.g., Zn, Pb, Sb or Mo) salt of dithiocarbamate, metallic (e.g., Pb) salt of naphthenate, metallic (e.g., Pb) salt of fatty acid, boron compound, phosphate ester, phosphite ester and phosphate ester amine, in addition to the zinc dithiophosphate as the essential component for the present invention. It is incorporated normally at 0.1 to 5 wt. %.

The extreme pressure agents useful for the present invention generally include an ashless-based sulfide compound, sulfurized oil and fat, phosphate ester, phosphite ester and phosphate ester amine. It is incorporated normally at 0.05 to 3 wt. %.

The metal deactivators useful for the present invention include benzotriazole, and a triazole, benzotriazole and thiadiazole derivative. It is incorporated normally at 0.001 to 3 wt. %.

The rust inhibitors useful for the present invention include a fatty acid, alkenyl succinic acid half ester, fatty acid soap, alkyl sulfonate, ester of a fatty acid and polyhydric alcohol, fatty acid amine, oxidized paraffin and alkyl polyoxyethylene ether. It is incorporated normally at 0.01 to 3 wt. %.

The antifoaming agents useful for the present invention include a dimethyl polysiloxane and polyacrylate. It is incorporated normally at a very small content, e.g., around 0.002 wt. %.

The lubricant oil composition of the present invention may be further incorporated, as required, with other types of additives, e.g., corrosion inhibitor and coloring agent.

EXAMPLES

The present invention is described further in detail by EXAMPLES and COMPARATIVE EXAMPLES, which do not limit the present invention. The friction-reducing effect and its sustainability were measured using a reciprocating type (SRV) friction/wear tester and by oxidation stability in the presence of NOx under the following conditions in EXAMPLES and COMPARATIVE EXAMPLES:

1. Evaluation by a reciprocating type (SRV) friction/wear tester Coefficient of friction was measured using a reciprocating type (SRV) friction/wear tester, and friction tests were conducted under the following conditions: Plate: 24 mm in diameter, 7 mm thick, Cylinder: 15 mm in diameter, 22 mm long, Temperature: 80° C., Load: 400 N, Amplitude: 1.5 mm, Frequency: 50 Hz, Testing period: 5 min.

2. Evaluation of sustainability of friction-reducing effect by oxidation stability in the presence of NOx was performed as follows. The oxidation test was conducted using air containing nitrogen oxide (NOx) gases, to simulate an engine exposed at high temperature to blow-by gases containing NOx gases, where 150 mL of the sample oil was exposed to a flow of air containing 1 vol. % of $NO_2$, flowing at 2 L/h ($NO_2$:0.02 L/h, air: 1.98 L/h) at 130° C. for 6 or 12 hours. Sustainability of the friction-reducing effect was evaluated by comparing coefficient of friction of the oxidized oil with that of the fresh one.

Example 1

EXAMPLE 1 used a solvent-refined paraffinic mineral oil (viscosity: 4.3 $mm^2/s$ at 100° C.) as the base oil, which was incorporated with a zinc dialkyl dithiophosphate, whose alkyl group was a mixture of primary C8 and secondary C3/C6 (primary/secondary alkyl ratio: 10/9 by weight) at 0.09 wt. % as phosphorus, based on the whole composition; sulfurized oxymolybdenum dithiocarbamate (MODTC) at 0.07 wt. % (700 ppm) as molybdenum; calcium salt of alkyl salicylate (Ca salicylate) having a total base number of 170 mg KOH/g at 3.2 wt. % (0.2 wt. % as Ca); Zn salt of alkyl salicylate (Zn salicylate) having a total base number of 130 mg KOH/g at 0.3 wt. % (0.03 wt. % as Zn); and other types of additives, e.g., ashless dispersant, viscosity index improver, pour point depressant, antioxidant and antifoaming agent at a total content of 18.1 wt. %. A commercial diesel engine was operated with the base oil to collect the soot, and the concentrated soot was incorporated in the above lubricant oil compositions at 1.0 wt. %. The lubricant oil composition was tested to determine coefficient of friction by an SRV friction/wear tester, and also coefficient of function for the oxidized oil by an SRV friction/wear tester in the oxidation stability test in the presence of NOx. The results are given in Table 1.

Examples 2 to 6

These examples prepared the lubricant oil compositions, in a manner similar to that for EXAMPLE 1, using the base oil, additive components and soot, given in Table 1. EXAMPLE 2 increased zinc salt of alkyl salicylate (Zn salicylate) content to 0.9 wt. % (0.10 wt. % as Zn), and the EXAMPLES 3 to 6 further incorporated the base oil with a sulfurized ester as the sulfur-based compound at 1.0 wt. % (0.1 wt. % as S). These lubricant oil compositions were tested to determine coefficient of friction by an SRV friction/wear tester, and also coefficient of friction for the oxidized oil by an SRV friction/wear tester in the oxidation stability test in the presence of NOx, in a manner similar to that for EXAMPLE 1. The results are given in Table 1.

TABLE 1

| | EXAMPLE 1 | EXAMPLE 2 | EXAMPLE 3 | EXAMPLE 4 | EXAMPLE 5 | EXAMPLE 6 |
|---|---|---|---|---|---|---|
| Base oil: Mineral oil, Viscosity: 4.3 $mm^2/s$ at 100° C. | Balance | Balance | Balance | Balance | Balance | Balance |
| Additive components, wt % | | | | | | |
| ZnDTP, (as P) | 0.09 | 0.09 | 0.09 | 0.09 | 0.09 | 0.09 |
| MoDTC (as Mo) | 0.07 | 0.07 | 0.07 | 0.07 | 0 | 0.07 |
| MoDTP (as Mo) | 0 | 0 | 0 | 0 | 0.07 | 0 |
| Ca salicylate (as Ca) (TBN: 170 mg KOH/g) | 0.2 | 0.2 | 0.2 | 0.2 | 0.2 | 0.16 |
| Zn salicylate (as Zn) (TBN: 130 mg KOH/g) | 0.03 | 0.10 | 0.10 | 0.10 | 0.10 | 0.03 |
| Ca sulfonate (as Ca) (TBN: 400 mg KOH/g) | 0 | 0 | 0 | 0 | 0 | 0.10 |
| Sulfurized ester (as S) | 0 | 0 | 0.1 | 0.1 | 0.1 | 0.1 |
| Other additives*1 | Added | Added | Added | Added | Added | Added |
| Soot content in oil (wt. %) | 1.0 | 1.0 | 1.0 | 3.0 | 1.0 | 1.0 |
| Coefficient of friction | | | | | | |
| • determined by an SRV friction/wear tester at 80° C.*2 | 0.050 | 0.050 | 0.045 | 0.050 | 0.050 | 0.050 |
| Oxidation stability test in the presence of NOx*3 | | | | | | |
| • Oxidation test time (hour) | 6 12 | 12 | 6 12 | 12 | 6 12 | 12 |

TABLE 1-continued

| | EXAMPLE 1 | | EXAMPLE 2 | EXAMPLE 3 | | EXAMPLE 4 | EXAMPLE 5 | | EXAMPLE 6 |
|---|---|---|---|---|---|---|---|---|---|
| • Coefficient of friction of the oxidized oil, determined by an SRV friction/wear tester at 80° C. | 0.055 | 0.085 | 0.090 | 0.055 | 0.080 | 0.091 | 0.060 | 0.081 | 0.085 |

*1Other additives were an ashless dispersant, viscosity index improver, pour point depressant, antioxidant and antifoaming agent at a total content of 18.1 wt. %.
*2The SRV friction/wear test was conducted under the conditions of temperature: 80° C., time: 30 min, load: 400N, amplitude: 1.5 mm and frequency: 50 Hz.
*3The oxidation stability test in the presence of NOx was conducted under the conditions of oil temperature: 130° C. and 1% $NO_2$/air flow rate: 2 L/h.

Comparative Examples 1 to 6

These examples prepared the lubricant oil compositions using the base oil, additive components and soot, given in Table 1. These lubricant oil compositions were tested to determine coefficient of friction by an SRV friction/wear tester, and also coefficient of friction for the oxidized oil by an SRV friction/wear tester in the oxidation stability test in the presence of NOx, in a manner similar to that for EXAMPLES 1 to 6. The results are given in Table 2.

TABLE 2

| | COMPARATIVE EXAMPLE 1 | COMPARATIVE EXAMPLE 2 | COMPARATIVE EXAMPLE 3 | COMPARATIVE EXAMPLE 4 | | COMPARATIVE EXAMPLE 5 | COMPARATIVE EXAMPLE 6 | |
|---|---|---|---|---|---|---|---|---|
| Base oil: Mineral oil, Viscosity: 4.3 $mm^2/s$ at 100° C. | Balance | Balance | Balance | Balance | | Balance | Balance | |
| Additive components, wt % | | | | | | | | |
| ZnDTP, (as P) | 0.09 | 0 | 0.09 | 0.09 | | 0.09 | 0.09 | |
| MoDTC (as Mo) | 0 | 0.07 | 0.07 | 0.07 | | 0.07 | 0.07 | |
| MoDTP (as Mo) | 0 | 0 | 0 | 0 | | 0 | 0 | |
| Ca salicylate (as Ca) (TBN: 170 mg KOH/g) | 0.2 | 0.2 | 0 | 0.2 | | 0.2 | 0.26 | |
| Zn salicylate (as Zn) (TBN: 130 mg KOH/g) | 0 | 0 | 0 | 0 | | 0 | 0 | |
| Ca sulfonate (as Ca) (TBN: 400 mg KOH/g) | 0 | 0 | 0 | 0 | | 0 | 0 | |
| Sulfurized ester (as S) | 0 | 0 | 0 | 0.3 | | 0.3 | 0.3 | |
| Other additives*1 | Added | Added | Added | Added | | Added | Added | |
| Soot content in oil (wt. %) | 1.0 | 1.0 | 1.0 | 1.0 | | 3.0 | 1.0 | |
| Coefficient of friction | | | | | | | | |
| • determined by an SRV friction/wear tester at 80° C.*2 | 0.151 | 0.137 | 0.070 | 0.052 | | 0.067 | 0.060 | |
| Oxidation stability test in the presence of NOx*3 | | | | | | | | |
| • Oxidation test time (hour) | 0 | 0 | 0 | 6 | 12 | 12 | 6 | 12 |
| • Coefficient of friction of the oxidized oil, determined by an SRV friction/wear tester at 80° C. | 0 | 0 | 0 | 0.065 | 0.120 | 0.147 | 0.063 | 0.115 |

*1Other additives were an ashless dispersant, viscosity index improver, pour point depressant, antioxidant and antifoaming agent at a total content of 18.1 wt. %.
*2The SRV friction/wear test was conducted under the conditions of temperature: 80° C., time: 30 min, load: 400N, amplitude: 1.5 mm and frequency: 50 Hz.
*3The oxidation stability test in the presence of NOx was conducted under the conditions of oil temperature: 130° C. and 1% $NO_2$/air flow rate: 2 L/h.

It is apparent, from the results of EXAMPLES and COMPARATIVE EXAMPLES, that the lubricant oil composition whose base oil was incorporated with the essential components of (A) organomolybdenum compound, (B) zinc dialkyl dithiophosphate, (C) Ca salt of alkyl salicylate and (D) Zn salt of alkyl salicylate at a specific content exhibits low coefficient of friction and friction-reducing effect, and also exhibits, when oxidized, low coefficient of friction and performance retention of the friction-reducing effect, as revealed by the oxidation stability test conducted in the presence of NOx, under the lubricating conditions with soot in the oil.

It is therefore apparent that a lubricant oil composition may not sufficiently exhibit its friction-reducing effect nor sustainability of the characteristics under the lubricating conditions with soot in the oil, and hence may not have sufficient quality as the lubricant oil for diesel engines, particularly a pressure-accumulating type one equipped with an EGR system, unless its base oil is incorporated with the essential components for the present invention, i.e., (A) organomolybdenum compound, (B) zinc dialkyl dithiophosphate, (C) Ca or Mg salt of alkyl salicylate and (d) Zn salt of alkyl salicylate at a specific content. In other words, it is apparent that the lubricant oil composition for diesel engines exhibiting excellent friction-reducing effect for extended periods under the lubricating conditions with soot in the oil can be obtained by incorporating its base oil with (A) organomolybdenum compound, (B) zinc dialkyl dithiophosphate, (C) Ca or Mg salt of alkyl salicylate and (D) Zn salt of alkyl salicylate at a specific content.

The lubricant oil composition of the present invention exhibits enhance effects of reducing friction loss stably for extended periods under the lubricating conditions with oil-insoluble soot in the oil by incorporating its base oil with (A) organomolybdenum compound, (B) zinc dialkyl dithiophosphate, (C) Ca or Mg salt of alkyl salicylate and (D) Zn salt of alkyl salicylate at a specific content. Therefore, it is suitable for diesel engines operating under the conditions with large quantifies of soot in the oil, especially a pressure-accumulating type diesel engine equipped with an exhaust gas recirculation (EGR) system.

What is claimed is:

1. A lubricant oil composition for internal combustion engines, comprising a base oil composed of a mineral and/or synthetic oil incorporated with at least four additives selected from (A) at least one organomolybdenum compound selected from the group consisting of sulfurized oxymolybdenum dithiocarbamate, sulfurized oxymolybdenum dithiophosphate, molybdenum phosphate and molybdenum-amine complex at 0.01 to 0.20 wt. % as Mo; zinc dialkyl dithiophosphate at 0.01 to 0.50 wt. % as P; one of Ca and Mg salts of alkyl salicylate at 0.05 to 1.0 wt. % as Ca or Mg; Zn salt of alkyl salicylate at 0.005 to 0.2 wt. % as Zn, all percentages being based on the whole composition.

2. A method for enhancing friction loss reduction in a pressure-accumulating type diesel engine equipped with an exhaust gas recirculation system by adding to the internal combustion engine a lubricating oil composition comprising a base oil composed of a mineral and/or synthetic oil incorporated with at least four additives selected from at least one organomolybdenum compound selected from the group consisting of sulfurized oxymolybdenum dithiocarbamate, sulfurized oxymolybdenum dithiophosphate, molybdenum phosphate and molybdenum-amine complex at 0.01 to 0.20 wt. % as Mo; zinc dialkyl dithiophosphate at 0.01 to 0.50 wt. % as P; one of Ca and Mg salts of alkyl salicylate at 0.05 to 1.0 wt. % as Ca or Mg; Zn salt of alkyl salicylate at 0.005 to 0.2 wt. % as Zn, all percentages being based on the whole composition.

* * * * *